United States Patent [19]

Ross et al.

[11] Patent Number: 4,581,977

[45] Date of Patent: Apr. 15, 1986

[54] BORESIGHT APPARATUS AND METHOD FOR MISSILES

[75] Inventors: Oakley G. Ross, Upland; Larry D. Wedertz, Mira Loma; Michael G. Greiner, Ontario, all of Calif.

[73] Assignee: General Dynamics, Pomona Division, Pomona, Calif.

[21] Appl. No.: 490,629

[22] Filed: May 2, 1983

[51] Int. Cl.[4] ..... F41G 11/00; G01B 11/26

[52] U.S. Cl. ..... 89/1.1; 89/1.816; 250/491.1; 356/138; 356/153

[58] Field of Search ..... 89/1 R, 1 A, 1.8, 1.816, 89/1.817; 244/3.1, 3.16; 33/234, 235; 73/167; 250/252.1, 491.1; 353/11, 12; 356/138, 153; 434/11, 24

[56] References Cited

U.S. PATENT DOCUMENTS

| | | | |
|---|---|---|---|
| 2,814,118 | 11/1957 | Evans et al. . | |
| 3,612,949 | 10/1971 | Becraft | 356/153 |
| 3,614,439 | 10/1971 | Beelik | 250/83 |
| 3,734,627 | 5/1973 | Edwards | 356/153 |
| 3,782,832 | 1/1974 | Hackaylo | 356/153 |
| 3,787,693 | 1/1974 | Stone | 250/330 |
| 3,894,804 | 7/1975 | Detwiler et al. | 356/121 |
| 3,941,345 | 3/1976 | Stripling et al. | 244/3.1 |
| 3,955,468 | 5/1976 | Romilly | 89/1.8 |
| 3,997,762 | 12/1976 | Ritchie et al. | 235/61.5 |
| 4,035,654 | 7/1977 | Elmer | 250/491 |
| 4,142,799 | 3/1979 | Barton | 356/153 |
| 4,165,463 | 8/1979 | Bowen | 250/372 |
| 4,168,429 | 9/1979 | Lough | 250/330 |
| 4,191,471 | 3/1980 | Courten et al. | 356/154 |
| 4,205,661 | 6/1980 | Chapman | 126/425 |
| 4,232,449 | 11/1980 | Linenberger | 33/235 |
| 4,327,292 | 4/1982 | Wang et al. | 250/491 |

FOREIGN PATENT DOCUMENTS 587605 11/1959 Canada .

*Primary Examiner*—Charles T. Jordan

*Attorney, Agent, or Firm*—Neil F. Martin; John R. Lindsay; Edward B. Johnson

[57] ABSTRACT

An apparatus and method for establishing the alignment of heat seeking missiles with the longitudinal axis of a launch pod within which the missiles are contained is disclosed. A housing containing a heat source and collimating optics provides a simulated distant infrared target for the missiles. A tapered probe rigidly attachable to the housing fits securely into a central alignment socket in the launcher pod. The probe is accurately offset from the center line of the alignment socket by the housing to establish the optical axis of the simulated target parallel to the axis of the launcher pod, and in front of the stored missiles. The position of the missile within the launch pod is adjustable to maximize the target signal strength received by the missile from the simulated target to achieve missile alignment with the axis of the launcher pod.

11 Claims, 7 Drawing Figures

BORESIGHT APPARATUS AND METHOD FOR MISSILES

BACKGROUND OF THE INVENTION

In modern weapon systems, it is often desirable and feasible to alter or extend the offensive or defensive capability of a particular system by providing different, but compatible, weapons useable with existing subsystems. In this way, improved capability and flexibility can be provided to the vehicle, ship or aircraft supporting the weapon system with minimum effort and cost. Combat missile systems are amenable to such variations. Preloaded missile launch pods, or missile magazines, of appropriate configuration and weight for substitution on a weapon system launcher, but containing different type missiles than the original design, are particularly adaptable. The launch pod strength and rigidity facilitates mounting of multiple missiles contained in the pod while maintaining a proper alignment with the original sighting/tracking and launching subsystems.

To be fully adaptable and effective, however, the alignment of missiles contained in the pod must be assured to an accuracy of less than 5 milliradian. Alignment, or boresighting, of multiple infrared homing missiles with the pods in which they are contained is not amenable to accomplishment with usual gun or single weapon techniques which require a distant target and extensive infrared signal exposure. It is desirable, therefore, to provide a compact self-contained portable apparatus and method which utilizes missile target acquisition capability for achieving such alignment quickly and easily at the loading depot and/or in the field. Applicants' invention meets these requirements.

SUMMARY OF THE INVENTION

According to the precepts of the invention, a compact housing contains an infrared source and power supply together with a collimating optical system to produce a simulated distant target. An alignment probe rigidly attachable to the housing project from the housing and is accurately mountable in an alignment socket positioned on the center line at the forward end of a launcher pod. The center line of the probe when attached to the housing is parallel to, and spaced from the simulated target optical axis to position the optical axis at the longitudinal center of a missile launch pod chamber when the probe is fixed in the alignment socket. The probe has a tapered end section upon which fits an expandable collar which is drawn forwardly by a positioning rod passing through the center of the probe to establish a firm fit of the probe in the alignment socket.

With the apparatus in place to align a selected missile, the infrared source is energized. The signal received by the missile from the simulated target is monitored by separate instrumentation connectable to the missile. The missile is aligned to the launch pod axis by adjusting its position in the chamber to maximize the received signal presented by the simulated target. According to the method of the invention, each missile contained in the pod is aligned in turn by rotating the position of the probe in the alignment socket to locate the optical output axis of the housing at the center of each missile chamber and parallel to the longitudinal axis of the pod before adjusting the position of the missile within the chamber to maximize the simulated target signal received by the missile.

The primary object of the invention is to provide a new and improved apparatus and method for boresighting heat seeking missiles with the axis of the launch pod in which they are contained. Applicants' apparatus provides a compact self-contained unit for such alignment at the loading depot or in the field. It is simple in design, light in weight, and easily operated. The alignment is accomplished immediately adjacent to the launcher pod and does not require extended space for a distant target, nor the exposure of infrared signals in an extended area. These, together with other objects and advantages, will become apparent when considering the details of the construction and operation of the missile boresight apparatus as they are more fully described. Reference will be made to the accompanying drawings wherein like numerals refer to like parts throughout and in which:

DETAILED DESCRIPTION OF THE DRAWINGS

Figure 1:
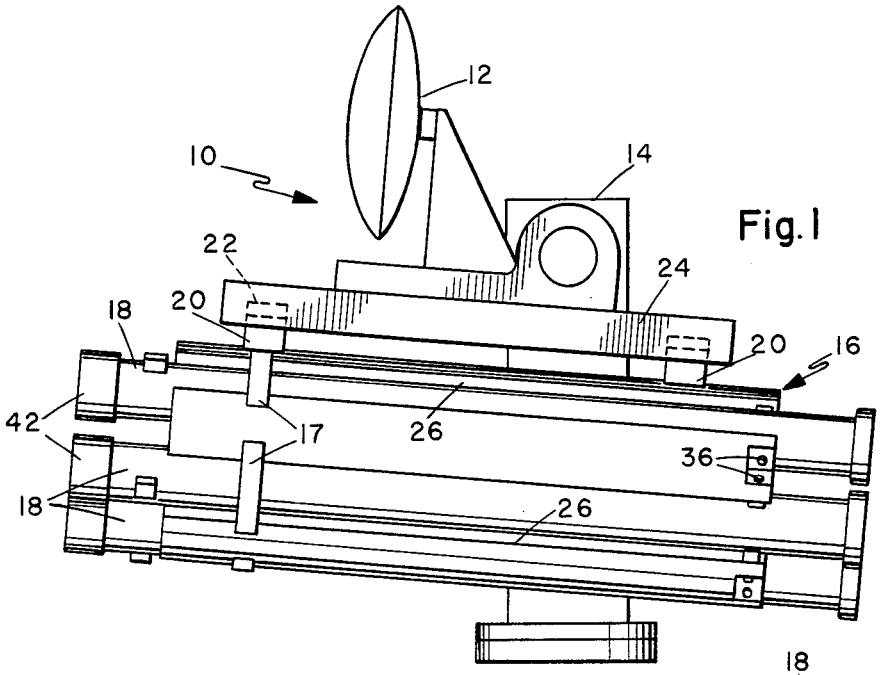
FIG. 1 is a side elevation view of a typical launching system with a missile pod attached.

A representative missile firing system 10 is illustrated in FIG. 1 and includes a target sighting and tracking subsystem 12, a launcher positioning subsystem 14, a missile launch pod 16 and associated fire control handling, and power drive components which are not shown. Multiple missile storage tubes 18 are loaded in the launch pod 16 and contain heat seeking missiles 19 (FIGS. 3 and 4) in a ready to fire condition. The storage tubes are held in the pod 16 by retaining clamp 17. The launch pod 16 containing the missiles 19 is replaceable on the launcher positioning subsystem 14. Mounting lugs 20 on the launch pod 16 are secured in recesses 22 on the launcher rail 24. It should be understood that the launch rail and lug arrangement permits varying configurations of missile launch pods or individual missiles to be mounted on the launch rail 24 for firing.

Proper alignment of the missile launch pod 16 with the sighting and tracking subsystem 12, and launcher positioning subsystem 14 is assumed to be established by independent procedures in the description that follows. Established alignment between the rail 24 and the launcher pod 16 is readily maintained by virtue of the sturdy construction of these elements and their components. Applicants' apparatus and method provides for establishing the alignment of the missile storage tubes 18, and the missiles 19 firmly supported therein, with the launch pod 16, thus insuring missile alignment with the other elements of the firing system 10.

Figure 2:
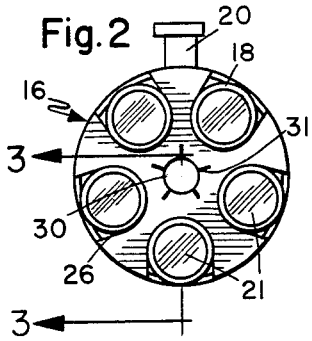
FIG. 2 is a front end view of a missile pod.
Figure 4:
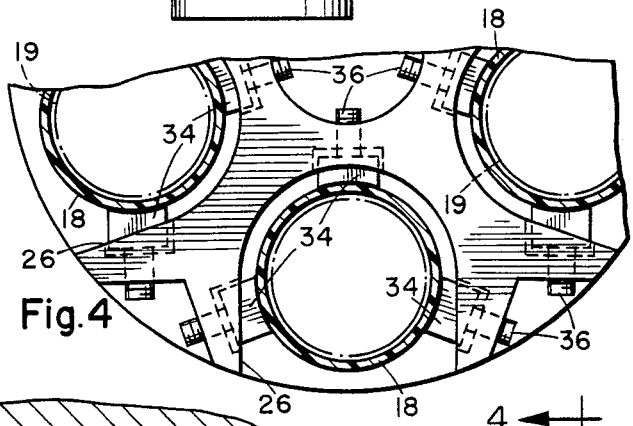
FIG. 4 is a sectional view taken on line 4—4 of FIG. 3.
Figure 3:
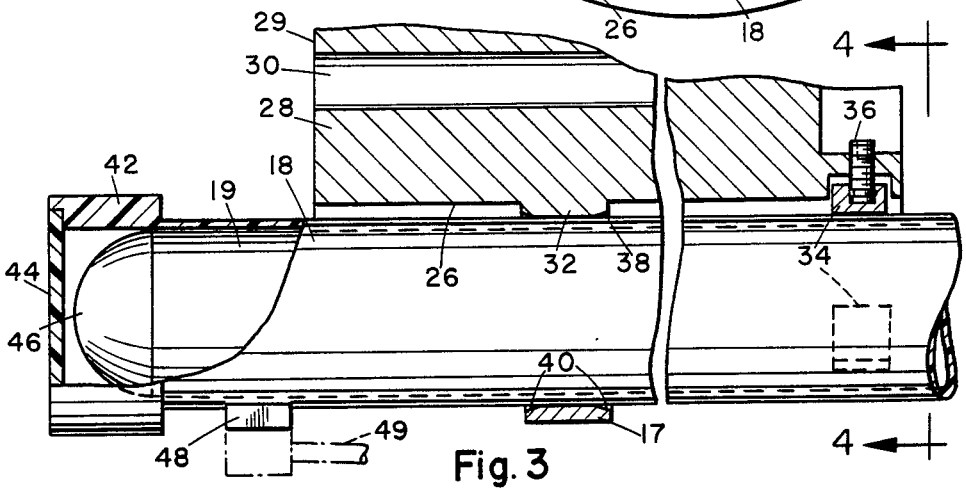
FIG. 3 is an enlarged sectional view taken on line 3—3 of FIG. 2.

Further structural details of the launch pod 16 and the mounting of missile storage tubes 18 and missiles 19 are illustrated in FIGS. 2, 3 and 4. The launch pod 16 has a generally cylindrical shape and is of rigid construction. It is formed with open sided longitudinal cylindrical chambers 26 spaced about a core section 28. The longitudinal axes of the chambers 26 are parallel to the longitudinal axis of the pod 16. An alignment socket 30 is accurately positioned in the center of the forward end of the core section 28. The longitudinal axis of the socket 30 coincides with centerline of pod 16. The centers 21 of the chambers 26 are located on a circle centered about the circular center of the socket 30. Pod index marks 31 are positioned on the face of core section 28 about the socket 30 for use in properly positioning the boresight apparatus on the pod 16 as will be subsequently described. The missiles 19 are housed and rigidly supported in the protective storage tubes 18. The construction and mounting of the missiles 19 within the storage tubes 18 are such that these elements form a single unit for alignment purposes. A representative tube 18 is illustrated being held in place in the chamber 26 by a clamp 17 which urges the missile tube against the chamber chock 32 located near the forward end of the chamber 26, and by adjusting blocks 34 and alignment screws 36 located adjacent to the after end of the chamber 26. The tube 18 is supported by 3 sets of blocks 34 and screws 36 arranged 120 degrees apart about the periphery of the tube. By selective adjustment of the screws 36, the alignment of the tube 18 within the chamber 26 of the launch pod can be altered. The edges of the chamber chock 32 and the clamp 17 are relieved as indicated at 38 and 40 to allow the tube 18 to pivot about the chock and clamp in effecting alignment.

As illustrated in FIG. 3, the storage tube 18 is equipped with a cap 42 at its forward end to seal the missile 19 within the tube 18. A lens 44 in the cap 42 permits transmission of infrared target signals through the cap for reception by the target acquisition head 46 of the missile 19. An umbilical connection 48 is mounted on the exterior surface of the tube 18 and has internal connection to the missile 19 for energizing, monitoring and firing the missile. An external power source and missile monitoring equipment (not shown) are made up by cable 49 to the connection 48 when using applicants' alignment apparatus and method.

Figure 5:
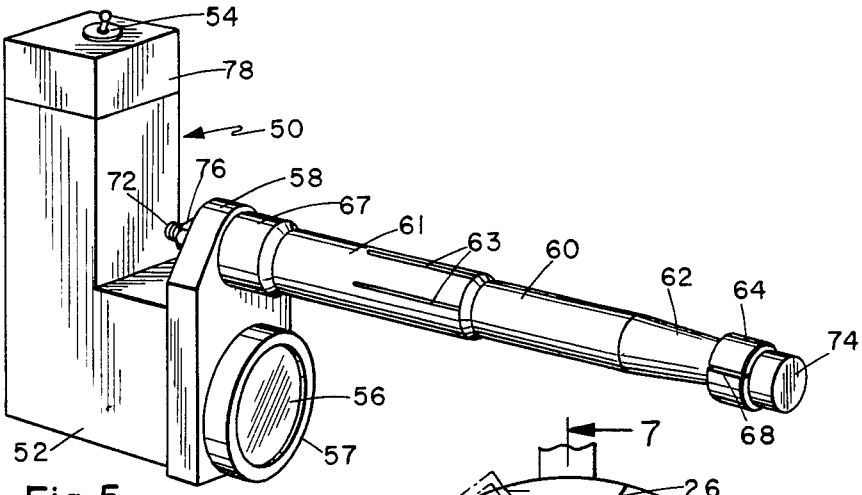
FIG. 5 is a perspective view of the alignment apparatus.

The self-contained alignment apparatus 50 is illustrated in FIG. 5. It comprises an L-shaped housing 52 which contains an infrared source and power supply controlled by the toggle switch 54 and internal optics including an adjustable collimating lens 56. The lens 56 may be focused by manipulation of the lens collar 57. Offset bracket 58 is formed integrally with the housing 52 and in conjunction with probe 60 provides the means for mounting the device 50 to the forward end 29 of the missile launch pod core section 28 (FIG. 7) as will be subsequently described. Referring again to FIG. 5, probe 60 has a shoulder section 67, a socket mating section 61, and a decreasingly tapered end section 62. Probe index marks 63 are positioned about the circumference of the mating section 61 and are used with the pod index marks 31 to establish the proper position of the apparatus 50 on the launch pod. A plastic collar 64 rides with a sliding fit on the tapered section 62. The internal surface 66 of collar 64 (FIG. 7) is tapered to conform with the shape of probe section 62. The collar 64 is placed on the probe section 62 such that the tapered sections complement each other. The collar 64 has a longitudinal split 68 to permit expansion of the collar 64 as it is moved along the increased taper of section 62. The complementary mating of the collar 64 and probe section 62 permits uniform expansion of the collar 64.

Figure 7:
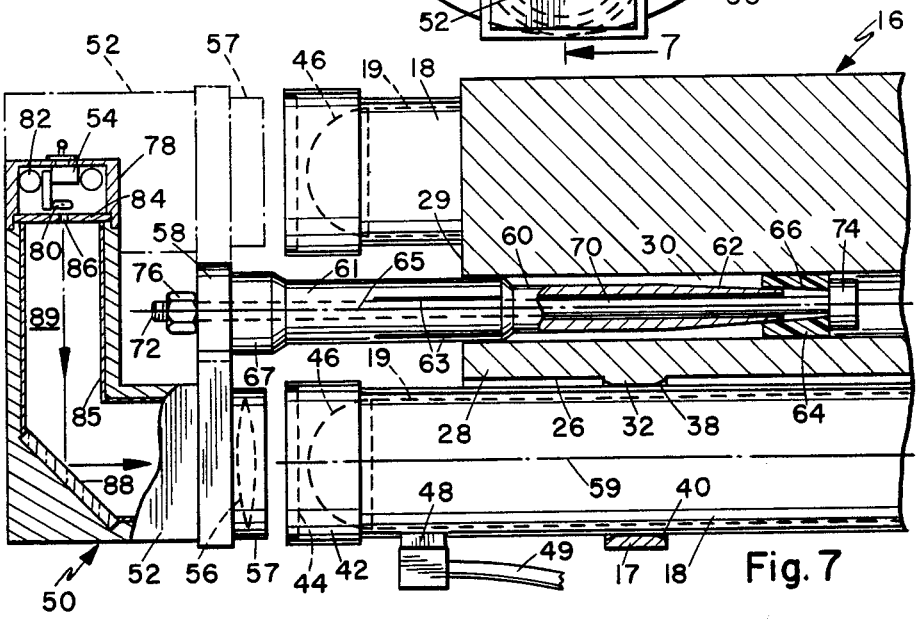
FIG. 7 is a sectional view taken on line 7—7 of FIG. 6.

As depicted in FIG. 7, probe 60 has a hollow cylindrical core, and bracket 58 has a hole in line therewith, through which passes a clamping rod 70. Rod 70 has a threaded section 72 at one end and a cap 74 at the opposite end. To mount the collar 64 upon the probe 60, the collar 64 is placed over the tapered section 62 of the probe as previously described. The clamping rod is then passed through the collar and through the bore of the probe 60. Nut 76 is threaded on section 72 of the rod after it has passed through the offset bracket 58. The arrangement is such that tightening of the securing nut 76 draws rod 70 toward the offset bracket 58, and in so doing advances collar 64 along the tapered section 62 of the probe 60 expanding collar 64 radially to secure the probe 60 in the alignment socket 30.

The infrared source and optical components of the alignment apparatus 50 and their arrangement within the housing 52 are illustrated in FIG. 7. Housing 52 has a removable end section 78 which contains the infrared source in the form of a wheat grain bulb 80 together with associated electrical supply batteries 82 and toggle switch 54. The bulb 80 is located centrally in the interior of the housing and section 78. Diaphragm 84 is mounted adjacent to the point of attachment of section 78 to the housing 52 and confines the energy output of the bulb 80. An aperture 86 is located in the center of diaphragm 84 in way of the bulb 80 to permit the infrared energy of the bulb to enter the interior 89 to the housing, and establishes the desired size of the simulated target. In the preferred embodiment aperture 84 is twenty-thousandths of an inch in diameter. The interior surfaces of the housing 52 are coated with an anti-reflective coating 85 to minimize interference patterns within the housing. Flat mirror 88 is employed to change the path of the infrared simulated target signal 90 degrees and direct it toward the collimating lens 56. The wheat grain bulb 80 is located at the focal point of the lens 56 so that the bulb energy emerges from the apparatus 50 as parallel rays to simulate a distant target. The configuration and spacing of the optical elements of the apparatus 50 are such that the optical output axis 59 is parallel to the longitudinal centerline 65 of the probe 60 when the probe is attached in the offset bracket 58 (FIG. 7). The energy output may be focused by positioning lens 56 by movement of the collar 57.

Figure 6:
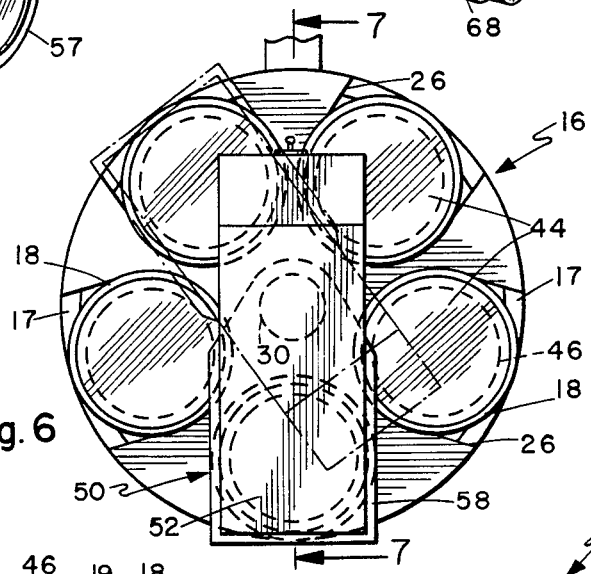
FIG. 6 is a front end view of a missile pod with the alignment apparatus in place.

The installation of the apparatus 50 upon a launch pod 16 for missile alignment is illustrated in FIGS. 6 and 7. In FIG. 6, the housing 52 as it would be positioned on the forward end of the pod 16 to align a missile in the 6 o'clock chamber of the pod is shown in solid line. Housing 52 is shown in broken line aligning a missile in the 11 o'clock chamber position.

OPERATION

The boresighting of missiles installed in a launch pod using the apparatus 50 would generally be accomplished at a depot or in a field environment.

To provide a loaded and aligned launch pod, the missile tubes 18 containing ready missiles 19 are first positioned in pod chambers 26 of the pod 16. The tubes are coarsely aligned by eye with the longitudinal axes of the chambers 26. Missile control and monitoring equipments are then connected to the missile to be first aligned by means of the umbilical connection 48 and cable 49 so that the target acquisition signal received by the missile may be noted during alignment. The missile is then activated with the target acquisition system of the missile caged so as to be in line with the missile longitudinal axes. The apparatus 50 is then installed on the front of the launcher pod 16. To accomplish this, collar 64 is first placed over the end of the tapered section 62 of the probe 60, and rod 70 is inserted through the collar 64, probe 60 and mounting bracket 58, threaded section 72 first. Probe 60 is secured to project from offset bracket 58 by tightening nut 76 on the threaded section of the rod until the shoulder 67 is in firm contact with the bracket 58. The probe 60 is then installed in the alignment socket 30 to position lens 56 in front of the chamber 26 of the missile to be aligned. The radial spacing between the probe centerline 65 and the optical axis 59 provided by the configuration of the apparatus 50 properly locates the optical axes on the circumference of the circle containing the chamber centers 21. The proper position of the optical axis along the circumference of the circle is established by matching the appropriate pair of pod and probe index marks 31 and 63. The probe is inserted into the aligning socket 30 to place the lens 56 of the apparatus approximately one half inch from the missile tube cap lens 44. The position of the probe is then fixed in the socket 30 by further tightening nut 76 on the rod 70 drawing the rod toward the apparatus 50. In so doing, the collar 64 is forced by cap 74 further along the tapered section 62 of the probe expanding the collar to establish a firm friction fit of the collar and probe in socket 30.

With the apparatus installed on the launch pod as described, the bulb 80 of the apparatus is energized using switch 54 to provide a simulated infrared target for the missile target acquisition system. The position of the missile tube 18 is then adjusted employing adjusting blocks 34 until the observed target signal strength received by the missile is maximized as indicated on the monitoring equipment. When it is desired to align another missile, the nut 76 is slackened, and the probe 60 is rotated to position the lens 56 in front of another chamber 26, and the alignment process is repeated.

Having described our invention, we claim:

1. An infrared boresight apparatus for use in aligning the longitudinal axes of a plurality of infrared homing missiles, equipped with target acquisition sensors, and supported in circumferentially positioned longitudinal chambers in a cylindrical launch pod, with the longitudinal axis of said launch pod, the invention comprising:

pod reference means on the forward end of said launch pod for establishing the longitudinal axis of said pod, a housing containing an infrared source and a collimating optical means aligned with the infrared source for projecting simulated distant target signals from the housing, a probe connectable to the housing by an offset bracket for attaching the housing in the pod reference means so that the projected target signals are parallel to and spaced radially from the pod longitudinal axis, means for selectably rotating the probe to position the projected target signals in line with the longitudinal axes of said chambers, means for monitoring the strength of the target signals received by said missile target acquisition sensors, and means for adjusting the alignment of said missiles within said chambers to maximize the target signal strength being received by said sensors.

2. An infrared boresight apparatus as recited in claim 1 wherein the pod reference means comprises:

a cylindrical socket formed in the pod and having a longitudinal axis coinciding with said longitudinal axis of said pod, and indicia means on the pod adjacent to the socket for indicating the circumferential locations of said chambers.

3. An infrared boresight apparatus as recited in claim 2 wherein the probe rotation means comprises:

a probe mating section sized to have a snug but rotatable fit in the socket, and indicia means on the mating section for matching with the pod indicia means.

4. An infrared boresight apparatus as recited in claim 1 wherein the infrared source further comprises:

an electric bulb mountable in the housing, diaphragm means adjacent the bulb for blocking the distribution of infrared energy produced by the bulb, the diaphragm means having an aperture in way of the bulb to define the size of the infrared source.

5. An infrared boresight apparatus as recited in claim 4, wherein:

the aperture has a diameter of twenty-thousandths of an inch.

6. An infrared boresight apparatus for use in aligning the longitudinal axes of a plurality of infrared homing missiles, equipped with target acquisition sensors, and supported in longitudinal chambers circumferentially positioned about a centered alignment socket of a cylindrical launch pod, with the longitudinal axis of said pod, the invention comprising:

a housing containing an infrared source and collimating optical means aligned with the infrared source for projecting simulated distant target signals from the housing, a probe connectable to the housing by an offset bracket for attaching the housing in said socket so that the projected target signals are parallel to and spaced radially from the pod longitudinal axis, means for selectably rotating the probe to position the projected target signals in line with the longitudinal axes of said chambers, means for monitoring the strength of the target signals received by said missile target acquisition sensors, and means for adjusting the alignment of said missiles within said chambers to maximize the target signal strength being received by said sensors.

7. An infrared boresight apparatus as recited in claim 6 wherein:

indicia means are positioned on the pod adjacent to said socket for indicating the circumferential locations of said chambers.

8. An infrared boresight apparatus as recited in claim 7 wherein the probe rotation means comprises:

a probe mating section sized to have a snug but rotatable fit in said socket, and indicia means on the mating section for matching with the pod indicia means.

9. An infrared boresight apparatus as recited in claim 6 wherein the infrared source further comprises:

an electric bulb mountable in the housing, diaphragm means adjacent the bulb for blocking the distribution of infrared energy produced by the bulb, the diaphragm means having an aperture in way of the bulb to define the size of the infrared source.

10. An infrared boresight apparatus as recited in claim 9 wherein:

the aperture has a diameter of twenty-thousandths of an inch.

11. A method for aligning the longitudinal axes of a plurality of infrared homing missiles, equipped with target acquisition sensors, and supported in circumferentially positioned longitudinal chambers in a cylindrical launch pod, with the longitudinal axis of said launch pod, comprising the steps of:

mounting on the forward end of said launch pod an infrared boresight apparatus for projecting simulated distant infrared target signals parallel to and spaced from the longitudinal axis of said pod, rotating the apparatus to position the projected target signals in line with the longitudinal axis of one of said chambers, monitoring the strength of the simulated target signal received by said target acquisition sensor of the missile in said chamber, adjusting the alignment of said missile within said chamber to maximize the strength of the target signal received by said missile target acquisition sensor, and rotating the apparatus to align the projected target signals with the longitudinal axis of another of said missile chambers and repeating the method until all of said missiles have been aligned.

* * * * *